US011417489B2

(12) United States Patent
Villiger

(10) Patent No.: US 11,417,489 B2
(45) Date of Patent: Aug. 16, 2022

(54) TRIP UNIT FIXATION IN A CIRCUIT BREAKER

(71) Applicant: Rockwell Automation Switzerland GmbH, Aarau (CH)

(72) Inventor: Beat Villiger, Aarau (CH)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 99 days.

(21) Appl. No.: 16/891,959

(22) Filed: Jun. 3, 2020

(65) Prior Publication Data

US 2021/0383993 A1 Dec. 9, 2021

(51) Int. Cl.

| | |
|---|---|
| ***H01H 1/64*** | (2006.01) |
| ***H01H 71/02*** | (2006.01) |
| ***H01H 71/08*** | (2006.01) |
| ***H01H 71/12*** | (2006.01) |

(52) U.S. Cl.

CPC ..... *H01H 71/08* (2013.01); *H01H 1/64* (2013.01); *H01H 71/025* (2013.01); *H01H 71/123* (2013.01)

(58) Field of Classification Search

CPC ..... H01H 1/64; H01H 71/025; H01H 71/08; H01H 71/123; H01H 71/0214

USPC ..... 200/293; 335/172

See application file for complete search history.

(56) References Cited

U.S. PATENT DOCUMENTS 3,774,129 A * 11/1973 Sugiyama ..... H01H 71/528 335/175
4,679,019 A * 7/1987 Todaro ..... H01H 71/50 335/169
4,860,162 A 8/1989 DeVizzi
4,929,920 A 5/1990 Meiners et al.
5,608,367 A 3/1997 Zoller et al.
5,634,554 A * 6/1997 Dimarco ..... H01H 71/08 335/172
6,172,586 B1 1/2001 Ferree et al.
6,265,680 B1 * 7/2001 Robertson ..... H01H 1/585 200/293
6,636,133 B2 * 10/2003 Raabe ..... H01H 9/42 335/18

(Continued)

FOREIGN PATENT DOCUMENTS

DE 102013209771 A1 11/2014

OTHER PUBLICATIONS

MS116-16, Product ID: 1SAM250000R1011, Catalog Description: MS116-16 Manual Motor Starter, Dated Feb. 18, 2020, pp. 1-8.

(Continued)

*Primary Examiner* — William A Bolton
(74) *Attorney, Agent, or Firm* — Kunzler Bean & Adamson; Bruce R. Needham

(57) ABSTRACT

A circuit breaker with improved trip unit fixation is disclosed. Another circuit breaker and a system also perform the functions of the circuit breaker. A circuit breaker includes a frame and a trip unit mounted in the frame. The trip unit includes a terminal for securing a wire to the trip unit. One of a wall of the frame and the trip unit include a protrusion and the wall of the frame or the trip unit without the protrusion includes an opening. The protrusion conforms to the opening and the protrusion and opening are positioned to oppose movement of the trip unit in a direction of a force resulting from securing the wire in the terminal.

20 Claims, 9 Drawing Sheets

(56) References Cited

U.S. PATENT DOCUMENTS

| | | | | |
|---|---|---|---|---|
| 7,250,836 | B2 * | 7/2007 | Fleege | H01H 71/08 335/6 |
| 7,876,192 | B2 * | 1/2011 | Bausch | H01H 71/0228 337/13 |
| 8,558,650 | B2 * | 10/2013 | Paek | H01H 71/2472 335/172 |
| 9,378,916 | B2 * | 6/2016 | Turner | H01H 11/00 |
| 9,601,296 | B2 * | 3/2017 | Yang | H01H 71/16 |
| 9,728,348 | B2 * | 8/2017 | Zhou | H01H 7/06 |
| 2012/0152705 | A1 * | 6/2012 | Nakano | H01H 71/08 200/293 |
| 2017/0338072 | A1 * | 11/2017 | Hiremath | H01H 71/025 |

OTHER PUBLICATIONS

MS132-32, Product ID: 1SAM350000R1015, Catalog Description: MS132-32 Manual Motor Starter, Date Feb. 18, 2020, pp. 1-9.

General Electric, "GE—General Electric Manual Motor Protectors, GPS Series", Item umber GPS2BHAT, Dated Feb. 18, 2020, pp. 1-3.

Iskra, Motor Protection Circuit Breakers MS32, MS18, pp. 1-26.

Lovato Electric, "Sm . . . series motor protection circuit breakers", pp. 1-2.

Lsis, Futuring Smart Energy, Manual Motor Starters, LS Meta-MEC Manual Motor Starters provide completed ranges up to 100A, pp. 1-52.

Schneider Electric, "Rotary Knob Manual Motor Starter, No Enclosure", Item #2MNK2, Dated Feb. 18, 2020, pp. 1-3.

Schneider Electric, Push Button Manual Motor Starter, No Enclosure, 1 to 1.6 Amps AC, Dated Feb. 18, 2020, pp. 1-3.

Siemens, Rotary Knob Manual Motor Starter, No Enclosure, 11 to 16 Amps AC, Dated Feb. 18, 2020, pp. 1-2.

Motor Protector BU MPW40-3-U010, Product: 12428117, Reference MPW40, Dated Feb. 18, 2020, pp. 1-5.

EPO, European Application No. 21176866.8, Extended European Search Report, dated Nov. 25, 2021, pp. 1-8.

* cited by examiner

Perspective View

Top View

Perspective View

Front View

Side View

Front Section View
A-A'

Perspective View

Front View

Side View

Front View

Top Section View

Top Section View

Front View

Side Section View

Front View

Top Section View

Front View

Top Section View

Front View

Top Section View

TRIP UNIT FIXATION IN A CIRCUIT BREAKER

CROSS-REFERENCE TO RELATED APPLICATIONS

Background Information

The subject matter disclosed herein relates to circuit breakers and more particularly relates to circuit breakers with a trip unit installed in a frame of the circuit breaker.

Brief Description

A circuit breaker with improved trip unit fixation is disclosed. Another circuit breaker and a system also perform the functions of the circuit breaker. A circuit breaker includes a frame and a trip unit mounted in the frame. The trip unit includes a terminal for securing a wire to the trip unit. One of a wall of the frame and the trip unit include a protrusion and the wall of the frame or the trip unit without the protrusion includes an opening. The protrusion conforms to the opening and the protrusion and opening are positioned to oppose movement of the trip unit in a direction of a force resulting from securing the wire in the terminal.

Another circuit breaker with improved fixation of a trip unit includes a frame with a plurality of trip unit slots and a trip unit mounted in each trip unit slot. Each trip unit includes a terminal for securing a wire to the trip unit. A wall of a trip unit slot of the plurality of trip unit slots or the trip unit mounted in the trip unit slot includes a protrusion and the wall of the trip unit slot or the trip unit mounted in the trip unit slot without the protrusion includes an opening. The protrusion conforms to the opening and the protrusion and opening are positioned to oppose movement of the trip unit mounted in the trip unit slot in a direction of a force resulting from securing the wire in the terminal.

A system for improved trip unit fixation in a circuit breaker includes an electrical device and a circuit breaker coupled to the electrical device. Power transmitted through the circuit breaker feeds the electrical device. The circuit breaker includes a frame and a trip unit mounted in the frame. The trip unit includes a terminal for securing a wire to the trip unit. A wall of the frame or the trip unit includes a protrusion and the wall of the frame or the trip unit without the protrusion includes an opening. The protrusion conforms to the opening and the protrusion and opening are positioned to oppose movement of the trip unit in a direction of a force resulting from securing the wire in the terminal.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1A:
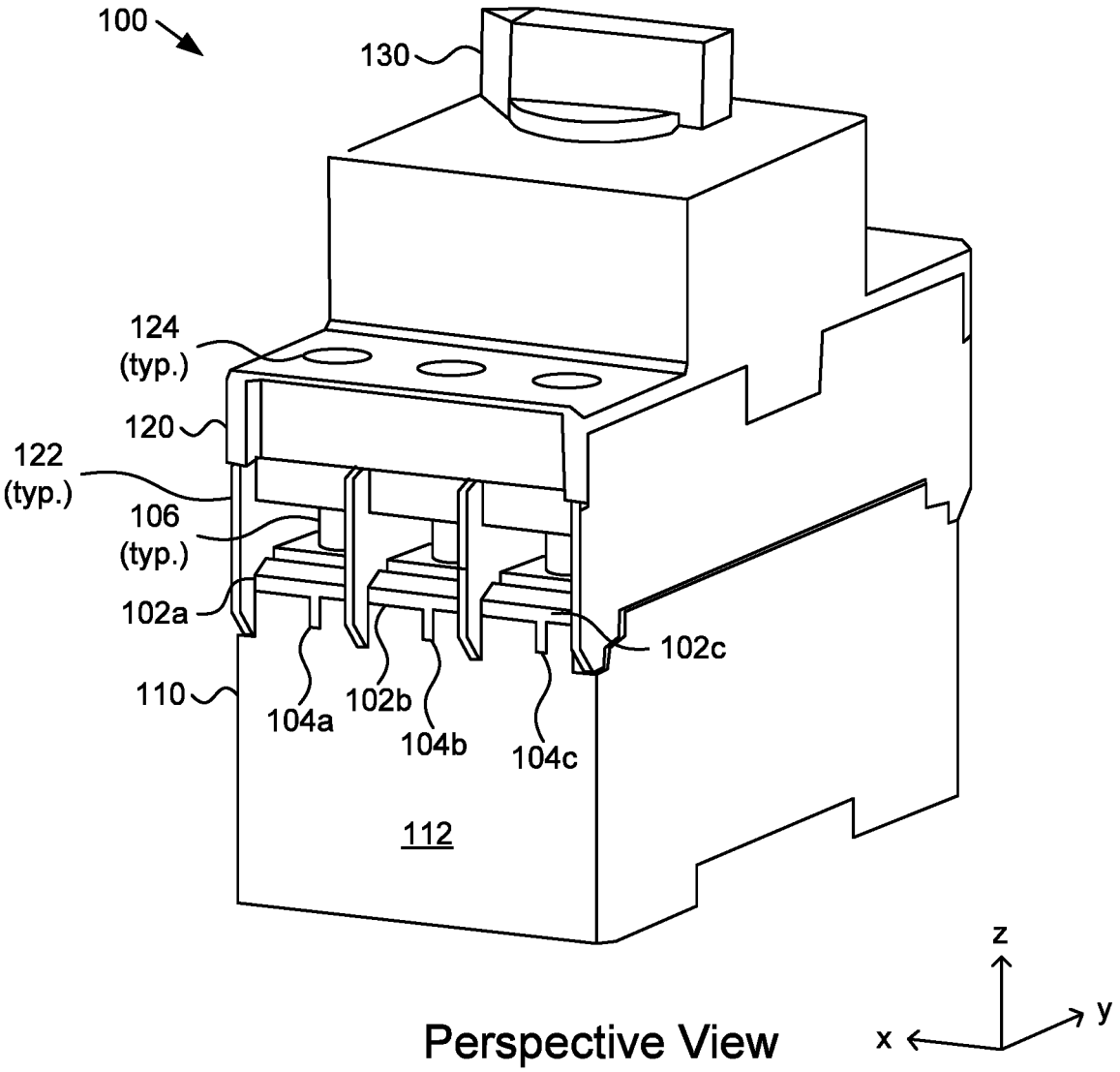
FIG. 1A is a perspective view illustrating one embodiment of a circuit breaker with improved trip unit fixation.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. The term "and/or" indicates embodiments of one or more of the listed elements, with "A and/or B" indicating embodiments of element A alone, element B alone, or elements A and B taken together.

The description of elements in each figure may refer to elements of proceeding figures. Like numbers refer to like elements in all figures, including alternate embodiments of like elements.

As used herein, a list with a conjunction of "and/or" includes any single item in the list or a combination of items in the list. For example, a list of A, B and/or C includes only A, only B, only C, a combination of A and B, a combination of B and C, a combination of A and C or a combination of A, B and C. As used herein, a list using the terminology "one or more of" includes any single item in the list or a combination of items in the list. For example, one or more of A, B and C includes only A, only B, only C, a combination of A and B, a combination of B and C, a combination of A and C or a combination of A, B and C. As used herein, a list using the terminology "one of" includes one and only one of any single item in the list. For example, "one of A, B and C" includes only A, only B or only C and excludes combinations of A, B and C. As used herein, "a member selected from the group consisting of A, B, and C," includes one and only one of A, B, or C, and excludes combinations of A, B, and C." As used herein, "a member selected from the group consisting of A, B, and C and combinations thereof" includes only A, only B, only C, a combination of A and B, a combination of B and C, a combination of A and C or a combination of A, B and C.

A circuit breaker with improved trip unit fixation is disclosed. Another circuit breaker and a system also perform the functions of the circuit breaker. A circuit breaker includes a frame and a trip unit mounted in the frame. The trip unit includes a terminal for securing a wire to the trip unit. One of a wall of the frame and the trip unit include a protrusion and the wall of the frame or the trip unit without the protrusion includes an opening. The protrusion conforms to the opening and the protrusion and opening are positioned to oppose movement of the trip unit in a direction of a force resulting from securing the wire in the terminal.

In some embodiments, the protrusion and the opening are located on a side of the trip unit where the wire is inserted. In other embodiments, the terminal includes a threaded shaft that is rotated to apply a force to the wire to secure the wire to the trip unit and rotating the threaded shaft produces the force that secures the wire to the trip unit in a direction perpendicular to the threaded shaft. In a further embodiment, the threaded shaft includes a head accessible from a top side of the trip unit and the wire is secured to the trip unit on a side of the trip unit and the protrusion or opening is on a bottom portion of the side of the trip unit distal to the head of the threaded shaft. In other embodiments, the frame includes a plurality of trip unit slots and each trip unit slot includes a trip unit. A wall of a trip unit slot of the plurality of trip unit slots or the trip unit in the trip unit slot includes the protrusion and the wall of the trip unit slot or the trip unit in the trip unit slot without the protrusion includes the opening.

In some embodiments, opposing movement of the trip unit in the direction of the force resulting from securing the wire in the terminal further opposes movement of a first component of the trip unit shaped to contact a second component of the frame and/or another trip unit. In other embodiments, the frame includes a trip unit slot where the trip unit is mounted and opposing movement of the trip unit in the direction of a rotational force resulting from securing the wire in the terminal further opposes deformation of a wall of the trip unit slot that allows trip unit movement due to the force. The wall of the trip unit slot affected by deformation is adjacent to the wall of the trip unit slot with the protrusion or opening.

In some embodiments, the wall of the frame includes the opening and the trip unit includes the protrusion. In other embodiments, the protrusion extends through the wall of the frame. In other embodiments, the opening in the wall of the frame includes a notch extending from a top edge of a trip unit slot where the trip unit is mounted in a direction away from the terminal of the trip unit and wherein the protrusion is shaped to fill the notch. In other embodiments, the opening in the wall of the frame includes an opening below a top edge of a trip unit slot where the trip unit is mounted and the protrusion of the trip unit is shaped to fill the opening. In other embodiments, the wall of the frame includes the protrusion and the trip unit includes the opening and the protrusion extends toward the trip unit and the opening in the trip unit is shaped to conform to the protrusion extending from the wall of the frame.

Another circuit breaker with improved fixation of a trip unit includes a frame with a plurality of trip unit slots and a trip unit mounted in each trip unit slot. Each trip unit includes a terminal for securing a wire to the trip unit. A wall of a trip unit slot of the plurality of trip unit slots or the trip unit mounted in the trip unit slot includes a protrusion and the wall of the trip unit slot or the trip unit mounted in the trip unit slot without the protrusion includes an opening. The protrusion conforms to the opening and the protrusion and opening are positioned to oppose movement of the trip unit mounted in the trip unit slot in a direction of a force resulting from securing the wire in the terminal.

In some embodiments, the protrusion and the opening are located on a side of the trip unit where the wire is inserted. In some embodiments, the terminal includes a threaded shaft that is rotated to apply a force to the wire to secure the wire to the trip unit and rotating the threaded shaft produces the force that secures the wire to the trip unit. In some embodiments, the threaded shaft includes a head accessible from a top side of the trip unit and the wire is secured to the trip unit on a side of the trip unit and the protrusion or opening is on a bottom portion of the side of the trip unit distal to the head of the threaded shaft.

In some embodiments, opposing movement of the trip unit in the trip unit slot in the direction of the force resulting from securing the wire in the terminal further opposes movement of a first component of the trip unit in the trip unit slot shaped to contact a second component of the trip unit slot. In some embodiments, opposing movement of the trip unit mounted in the slot in the direction of the force resulting from securing the wire in the terminal further opposes deformation of a wall of the trip unit slot that allows trip unit movement due to a rotational force, where the wall of the trip unit slot affected by deformation is adjacent to the wall of the trip unit slot with the protrusion or opening. In some embodiments, the wall of the trip unit slot includes the opening and the trip unit mounted in the slot comprises the protrusion.

A system for improved trip unit fixation in a circuit breaker includes an electrical device and a circuit breaker coupled to the electrical device. Power transmitted through the circuit breaker feeds the electrical device. The circuit breaker includes a frame and a trip unit mounted in the frame. The trip unit includes a terminal for securing a wire to the trip unit. A wall of the frame or the trip unit includes a protrusion and the wall of the frame or the trip unit without the protrusion includes an opening. The protrusion conforms to the opening and the protrusion and opening are positioned to oppose movement of the trip unit in a direction of a force resulting from securing the wire in the terminal.

Figure 1B:
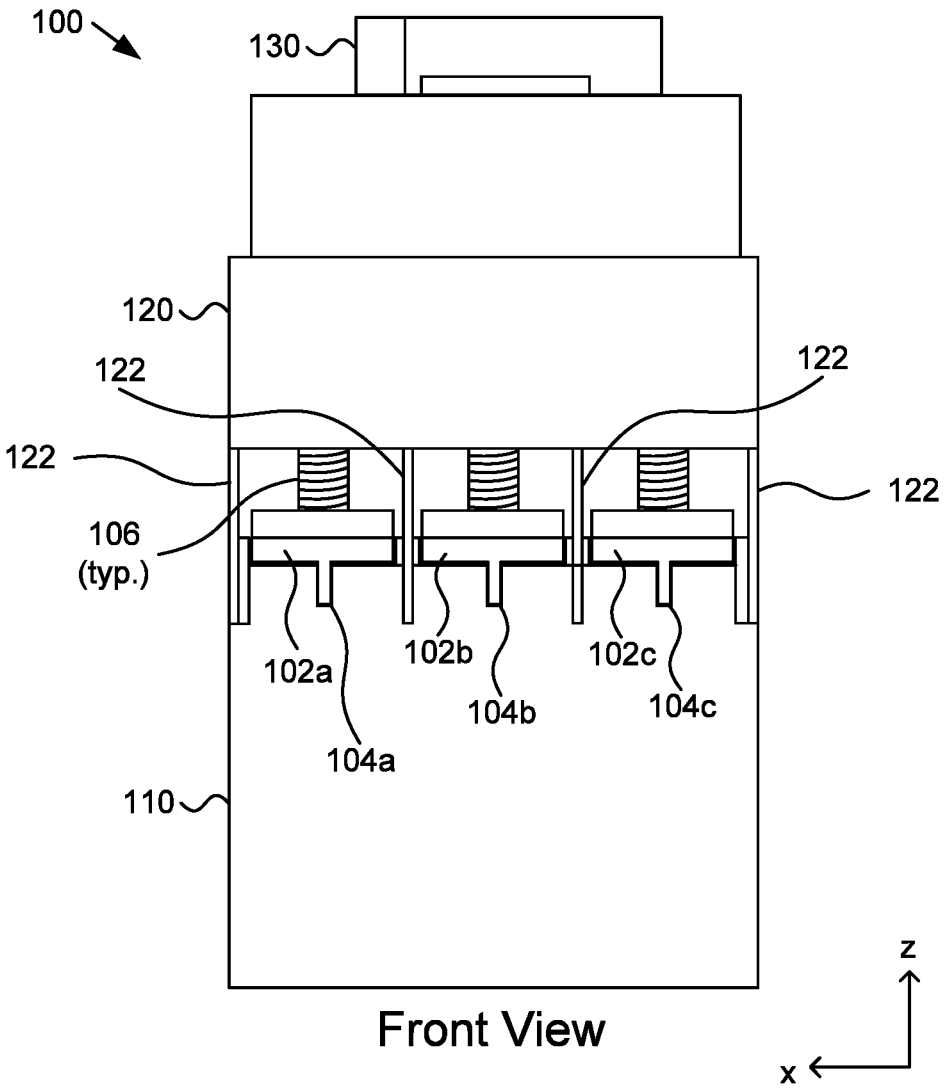
FIG. 1B is a front view further illustrating the circuit breaker with improved trip unit fixation of FIG. 1A.
Figure 1C:
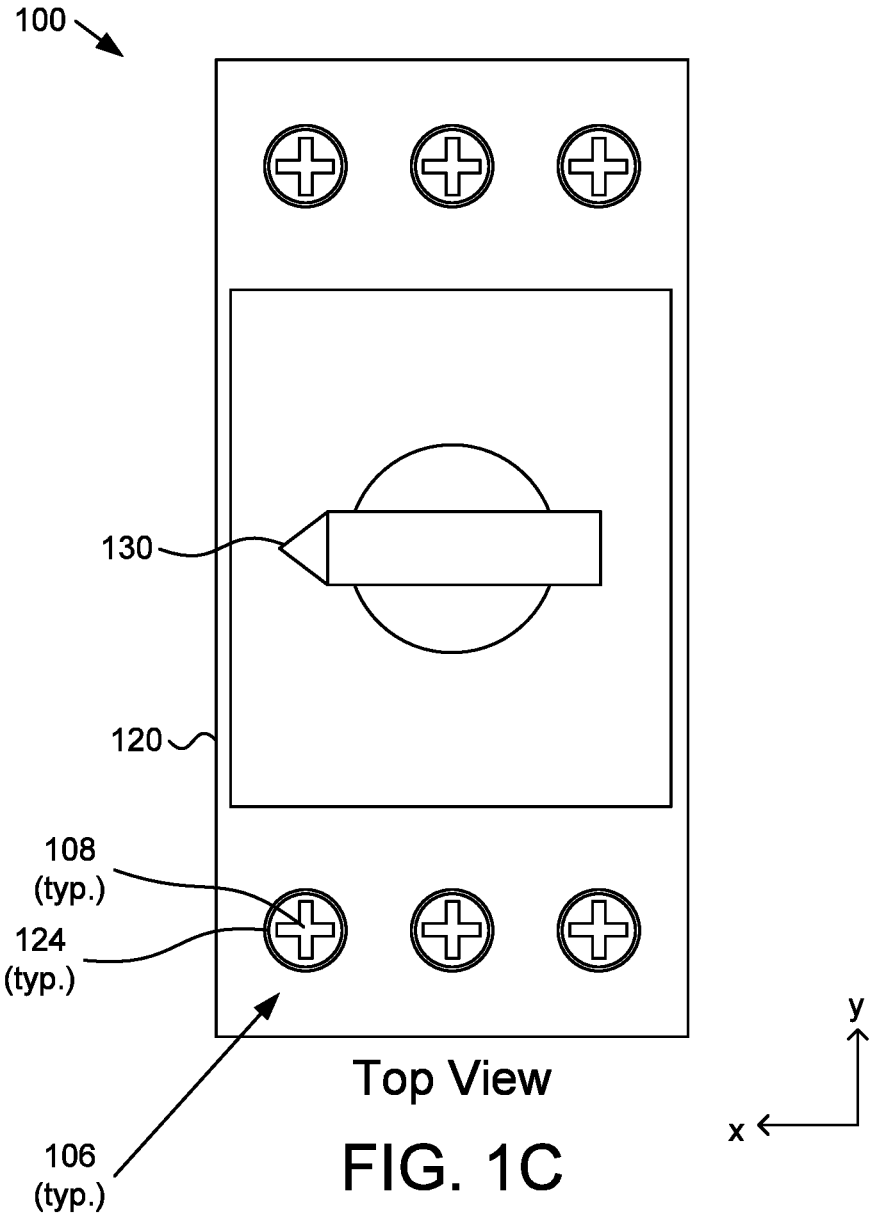
FIG. 1C is a top view further illustrating the circuit breaker with improved trip unit fixation of FIG. 1A.

FIG. 1A is a perspective view illustrating one embodiment of a circuit breaker 100 with improved trip unit fixation. FIG. 1B is a front view and FIG. 1C is a top view further illustrating the circuit breaker with improved trip unit fixation of FIG. 1A. The circuit breaker 100 with the improved trip unit fixation includes a first trip unit 102*a*, a second trip unit 102*b* and a third trip unit 102*c* (collectively or generically "trip unit 102") with a first protrusion 104*a*, a second protrusion 104*b*, and a third protrusion 104*c* respectively (collectively or generically "protrusion 104"), a bolt 106 for each trip unit 102, a frame 110, a top cover 120 with a side walls 122 on the sides of and in between trip units 102, and openings 124 for the bolts 106, and an actuator 130, which are explained below.

Circuit breakers provide overcurrent protection for wiring and other equipment. For example, a particular wire size and type may be rated for 55 amperes ("A") so a 50A circuit breaker may be used to protect the wire from the circuit breaker to equipment connected to the wire. In some cases, a circuit breaker also protects equipment connected to the wire, such as a motor, an appliance, etc. Larger circuit breakers are often stand-alone circuit breakers mounted in or near equipment. For example, a circuit breaker may be mounted in a motor controller, motor starter, equipment enclosure, etc. Often, stand-alone circuit breakers are multi-pole and have either two poles for line-to-line single phase power or three poles for three-phase power.

Stand-alone circuit breakers are typically connected to incoming and outgoing wires via a terminal. Other circuit breakers may mount to a panel and have an input connected to bus bars while output terminals are connected to wires and protect the wiring and equipment connected to the output terminals. In some embodiments, a circuit breaker 100 feeds and/or is part of an electrical component. For example, the electrical component may be a motor starter, a variable frequency drive, a contactor, etc. In some embodiments, the circuit breaker 100 is housed within the electrical component. In other embodiments, the circuit breaker 100 is sold together with the electrical component.

Typically, standalone circuit breakers, such as the circuit breaker 100 of FIGS. 1A, 1B and 1C have a frame 110 that houses the trip units 102. In some embodiments, the frame 110 is called a housing. A top cover 120 is placed over the trip units and may extend to the frame 110. An actuator 130 is used to mechanically open and close contacts of the circuit breaker 100. The actuator 130 may be a dial, as depicted in FIG. 1C, may be a lever that moves back and forth, or the like.

Circuit breakers 100 typically have an inverse-time characteristic used to determine when the circuit breaker will trip on overcurrent. Current flowing in the circuit breaker 100 at or less than the circuit breaker rating does not cause the circuit breaker 100 to trip (with certain exceptions, such as a ground-fault interrupt ("GFI") circuit breaker). An overcurrent of 10 percent typically causes a circuit breaker 100 to open within minutes. An overcurrent of 100 percent typically causes a circuit breaker 100 to open within seconds, and overcurrent of 200 percent typically causes a circuit breaker 100 to open within milliseconds. Some circuit breakers 100 also include adjustments to the inverse-time characteristic for circuit breaker coordination. Some circuit breakers 100 include an inverse-time characteristic shaped to allow for motor inrush current, which may be in the range of 1100 percent to 2000 percent of the rating of the circuit breaker 100, or possibly higher, so the inverse-time characteristic is adjusted to not trip during motor inrush current. Where the circuit breaker 100 includes a motor as a load, the circuit breaker 100 is typically rated to handle motor inrush current.

Often, a circuit breaker 100 will include a bimetal strip used for overcurrent protection that contributes to the inverse-time characteristic. Often circuit breakers 100 may also include a short-circuit trip section that trips the circuit breaker 100 as quickly as possible for overcurrent above a particular value. The overcurrent section with the bimetal strip and short circuit section of the circuit breaker 100 are sensitive to placement and mechanical forces. Typically, a circuit breaker 100 is designed to withstand a particular maximum short circuit current limit. High current through a circuit breaker 100 causes mechanical forces, torque, etc. that are capable of causing a circuit breaker 100 to explode or be damaged prior to opening if short circuit current is higher than the short circuit current limit of the circuit breaker 100.

While circuit breakers 100 are designed for a particular maximum short circuit current, other mechanical forces may cause problems with the bimetal strip, contacts and/or the short circuit current sections of the circuit breaker 100. If mechanical forces cause movement of the bimetal strip, circuit breaker contacts, etc. accuracy of the circuit breaker 100 may be affected.

Often, circuit breakers 100 include one or more trip units 102, a frame 110 where the trip units are placed, a top cover 120, and an actuator 130. In some embodiments, the frame 110 is of a particular size. Certain frame sizes accommodate trip units 102 of particular ampere ratings. For example, a D-frame circuit breaker 100 may have current ratings from 0.5 A to 30 A in discrete increments. Frame sizes may also indicate particular features for a manufacturer.

FIGS. 1A-1C depict a circuit breaker 100 that includes overcurrent trip units 102 on one side and short circuit trip units 102 on the other side of the frame 110. The trip units 102 interact so that a trip unit 102 on one side interacts with a trip unit 102 on the back side of the trip unit 102. Each of the trip units 102 include a terminal where wires can be secured to the trip unit 102 with a bolt 106.

An issue that affects typical circuit breaker accuracy and performance is that when a wire is secured to a trip unit 102, torque and various mechanical forces cause the trip unit 102 to move within the frame 110, which causes the bimetal strip and/or components of the short circuit trip unit, contacts, etc. to move enough to affect accuracy of the circuit breaker 100. Often, securing wire into the terminal of a trip unit causes the trip unit 102 to move laterally, which may cause deflection of the side walls 122 adjacent to each circuit breaker 100. In some embodiments, the side walls 122 are part of the top cover 120 and in other embodiments, the side walls 122 are part of the frame 110. For example, as the bolt 106 is screwed into the trip unit 102, rotational forces may cause the trip unit 102 to move, which may deflect the side walls 122. Often, the trip units 102 do not return to an initial location after the wire has been secured to the trip units 102.

The circuit breaker 100 depicted in FIGS. 1A-1C include a frame 110 and a trip unit 102 mounted in the frame 110. The trip unit 102 includes a terminal for securing a wire to the trip unit 102. A protrusion 104 in the trip unit 102 or wall of the frame 110 and the trip unit 102 or wall of the frame 110 without the protrusion 104 includes an opening that conforms to the protrusion 104 where the protrusion 104 and opening are positioned to oppose movement of the trip unit 102 in a direction of a force resulting from securing the wire in the terminal.

In some embodiments, opposing movement of the trip unit 102 in the direction of the force resulting from securing the wire in the terminal also opposes movement of a first component of the trip unit 102 shaped to contact a second component of the frame 110 or another trip unit 102. The first component and the second component may be electrical, mechanical or both. For example, the first component may be a bimetal strip, a contact, etc. and the second component in the frame 110 may include another contact or other conductive part that is intended to make contact and conduct electricity with the trip unit 102.

In one embodiment, the protrusion 104 and the opening are located on a wall 112 of the trip unit where the wire is inserted. In this embodiment, the location of the protrusion 104 is close to where movement is anticipated due to securing the wire in the terminal of the trip unit 102. In addition, movement of the trip unit 102 caused by securing the wire in the terminal of the trip unit 102 is typically in the direction of the X-axis with regard to the position axis depicted in FIGS. 1A and 1B and the wall 112 of the frame 110 and trip unit 102 where the wire is inserted into the terminal of the trip unit 102 runs in the X and Z axes so placement of the protrusion 104 into an opening this wall 112 beneficially minimizes movement of the trip unit 102 in the X-axis direction.

In some embodiments, the terminal of the trip unit 102 includes a threaded shaft, usually in the form of a bolt 106, that is rotated to apply a force to the wire to secure the wire to the trip unit 102 and rotating the threaded shaft produces the force that secures the wire to the trip unit 102 in a direction perpendicular to the threaded shaft (e.g. in a direction of the X-axis or in the X-Y plane). The trip unit 102 extends into the circuit breaker 100 in a direction of the Z-axis within a slot in the frame 110 so the portion of the trip unit 102 in the Y-axis direction and behind the terminal of the trip unit 102 minimizes rotation in the X-Y plane, but using the bolt 106 to secure the wire to the terminal causes movement of the trip unit 102 particularly near the terminal, which in turn does cause some movement elsewhere in the trip unit 102. The protrusion 104 and corresponding opening of the trip unit 102/frame 110 opposes the movement caused by the rotation of the threaded shaft of the bolt 106.

In some embodiments, the threaded shaft of the bolt 106 includes a head 108 accessible from an opening 124 of the top cover 120 and a top side of the trip unit 102. While the head 108 is depicted with slots for a Pozidriv® screwdriver, a Philips screwdriver, other openings in the head 108 may be used, such as a slot for a flat-blade screwdriver, a Torx® head, an hex key, a combination slot for a flat-blade screwdriver or Pozidriv/Philips screwdriver, etc. In the embodiment, the wire is secured to the trip unit 102 on a side of the trip unit 102 and the protrusion 104 or opening is on a bottom portion of the side of the trip unit 102 distal to the head 108 of the threaded shaft of the bolt 106.

In the circuit breaker 100 of FIGS. 1A, 1B and 1C, the protrusion 104 of a trip unit 102 (e.g. protrusion **104*a* and trip unit 102*a*) is depicted as centered in the X-axis direction with respect to the trip unit 102. In other embodiments, the protrusion 104 is off-center with respect to the trip unit 102 and may be left-of-center or right-of-center within a width of the trip unit 102. In some embodiments, two or more protrusions 104*a*, 104*b*, 104*c* are spaced differently across a width of the respective trip units 102*a*, 102*b*, 102*c***.

Figure 2:
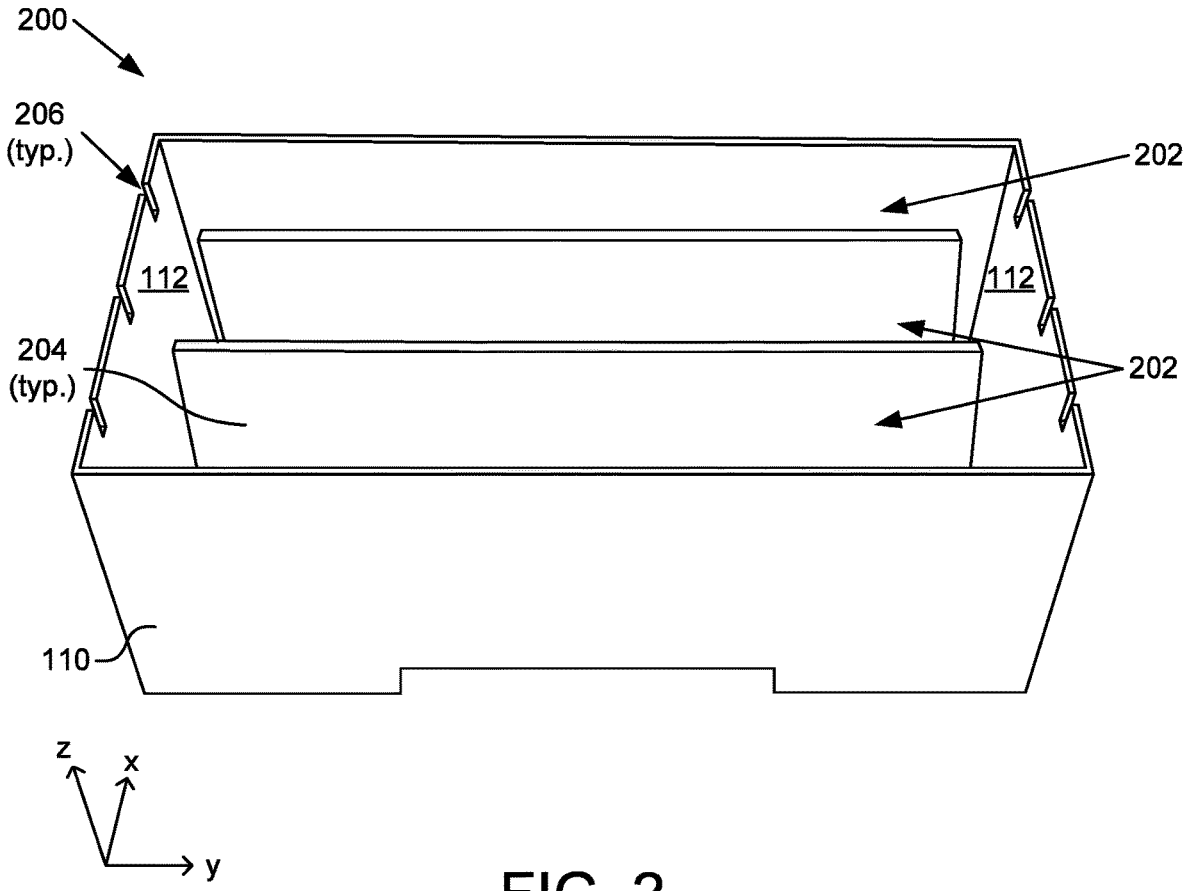
FIG. 2 is a perspective view illustrating a frame of an embodiment of a circuit breaker with improved trip unit fixation.

FIG. 2 is a perspective view illustrating a frame 110 of an embodiment 200 of a circuit breaker 100 with improved trip unit fixation. The frame 110 includes a plurality of trip unit slots 202 and each trip unit slot 202 is sized for at least one trip unit 102. The trip unit slots 202, in the embodiment 200, include divider walls 204 separating the trip unit slots 202. In the depicted embodiment 200, each trip unit slot 202 includes space for two trip units 102, each having a terminal against a wall 112 on opposite ends of the frame 110 and at opposite ends of a trip unit slot 202. In other embodiments, each trip unit slot 202 is sized for one trip unit 202 where the trip unit 202 has short circuit and inverse-time functions in the single trip unit 202. A wall 112 of a trip unit slot 202 of the plurality of trip unit slots 202 or the trip unit 102 in the trip unit slot 202 includes the protrusion 104 and the wall 112 of the trip unit slot 202 or the trip unit 102 in the trip unit slot 202 without the protrusion 104 has the opening. In the depicted embodiment 200, the frame 110 includes the openings 206 and the trip units 102 include the protrusions 104.

Typically, the trip unit slots 202 are sized to match dimensions of the trip units 102. For example, a width of a trip unit slot 202 may match a width of a trip unit to minimize lateral movement of the trip unit 102. In other embodiments, the trip unit slots 202 and trip units 102 include various tabs, openings, latches, etc. so that when a trip unit 102 is placed in a trip unit slot 202, the trip unit 102 will be secure within the trip unit slot 202. In addition, the protrusion 104 matches the opening 206 so that placement of the trip unit 102 in the trip unit slot 202 places the protrusion 104 in the opening 206. In some embodiments, the frame 110 and/or trip unit 102 include slots, gaps, protrusions, latches, ledges, etc. designed to hold the trip unit 102 into the frame 110. Also, when the trip unit 102 is placed in the trip unit slot 202, in some embodiments, the trip unit 102 is secured to the trip unit slot 202. In other embodiments, placement of the top cover 120 over the trip unit 102 secures the trip unit 102 to the frame 110 and top cover 120. One of skill in the art will recognize other ways to secure a trip unit 102 in a trip unit slot 202 where the protrusion 104 is also secured in the opening 206.

In some embodiments where the protrusion 104 is on the trip unit 102, the protrusion 104 extends through the wall 112 of the frame 110. The protrusion 104, in some cases, may extend an amount past the wall 112 of the frame 110. In other embodiments, the protrusion 104 extends through the wall 112 of the frame 110 an amount so an end of the protrusion 104 is flush with a face of the wall 112. In other embodiments, the protrusion 104 does not penetrate all the way through the wall 112, but extends deep enough into the wall 112 to prevent lateral movement of the trip unit 102. Other configurations of a protrusion 104 and an opening 206 are discussed in more detail below.

Figure 3A:
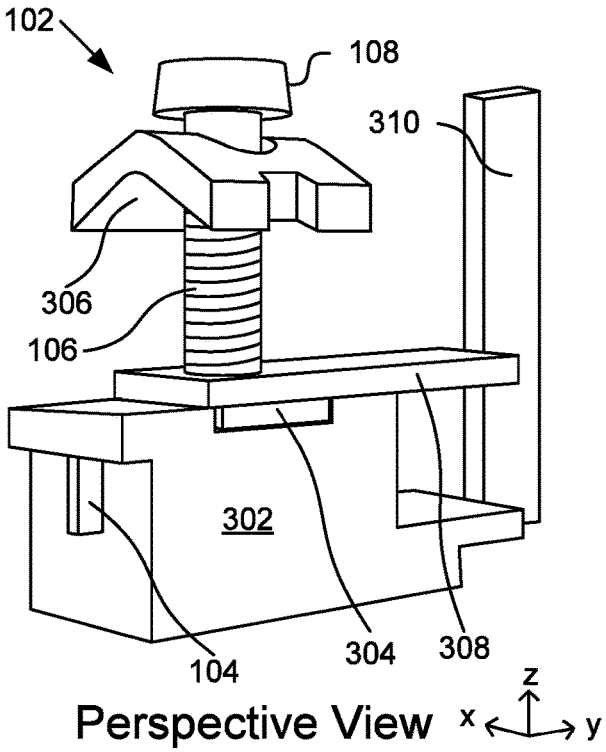
FIG. 3A is a perspective view illustrating one embodiment of a trip unit of a circuit breaker with improved trip unit fixation.
Figure 3B:
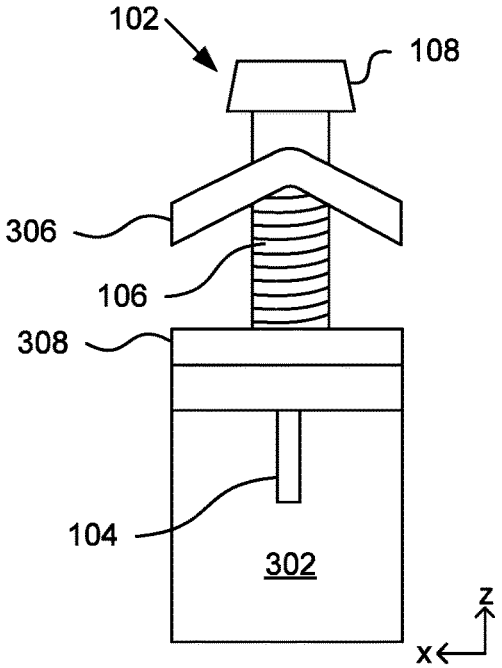
FIG. 3B is a front view further illustrating the embodiment of the trip unit of FIG. 3A.
Figure 3C:
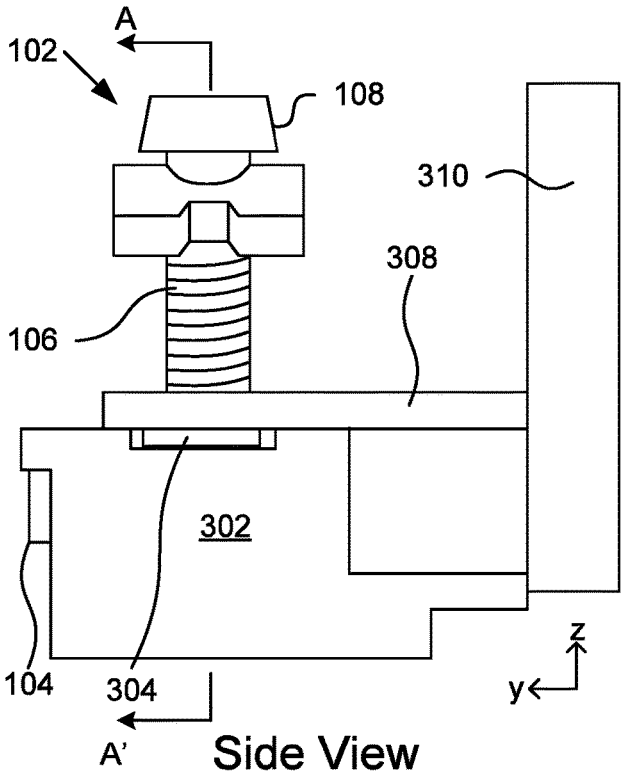
FIG. 3C is a side view further illustrating the embodiment of the trip unit of FIG. 3A.
Figure 3D:
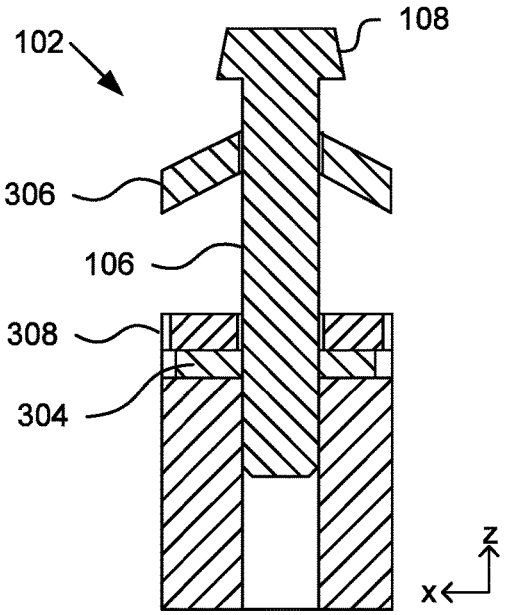
FIG. 3D is a front section view further illustrating the embodiment of the trip unit of FIG. 3A.

FIG. 3A is a perspective view illustrating one embodiment of a trip unit 102 of a circuit breaker 100 with improved trip unit fixation. FIG. 3B is a front view further illustrating the embodiment of the trip unit 102 of FIG. 3A. FIG. 3C is a side view further illustrating the embodiment of the trip unit 102 of FIG. 3A. FIG. 3D is a front section view A-A' further illustrating the embodiment of the trip unit 102 of FIG. 3A. For example, the embodiment of FIGS. 3A-3D may depict a trip unit 102 with a bimetal strip 310. In the embodiment, the trip unit 102 includes at least a trip unit body 302 with a nut 304 where the bolt 106 is threaded, an angled clamp 306, a conductive element 308 and the bimetal strip 310. In other embodiments, the conductive element 308 is threaded so that the bolt 106 is screwed into the conductive element 308 and the embodiment does not include a nut 304. Note that the embodiment depicted in FIGS. 3A-3D is one particular design and other designs of trip units 102 with a bimetal strip and with or without short circuit current elements that include a protrusion 104 and/or opening 206 are contemplated herein. Typically, the body 302 of the trip unit 102 is shaped to fit in a trip unit slot 202 of the frame 110 and is shaped to accommodate the nut 304, the bolt 106, the conductive element 308, bimetal strip 310 and other parts.

Figure 4A:
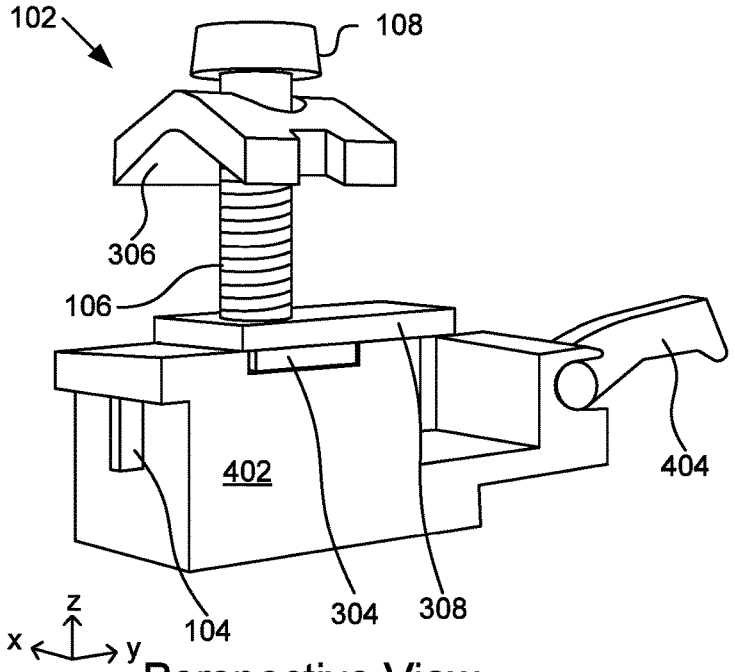
FIG. 4A is a perspective view illustrating one embodiment of another trip unit of a circuit breaker with improved trip unit fixation.
Figure 4B:
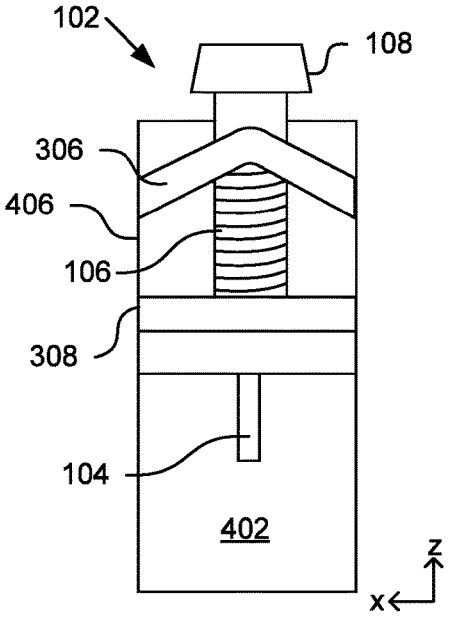
FIG. 4B is a front view further illustrating the embodiment of the trip unit of FIG. 4A.
Figure 4C:
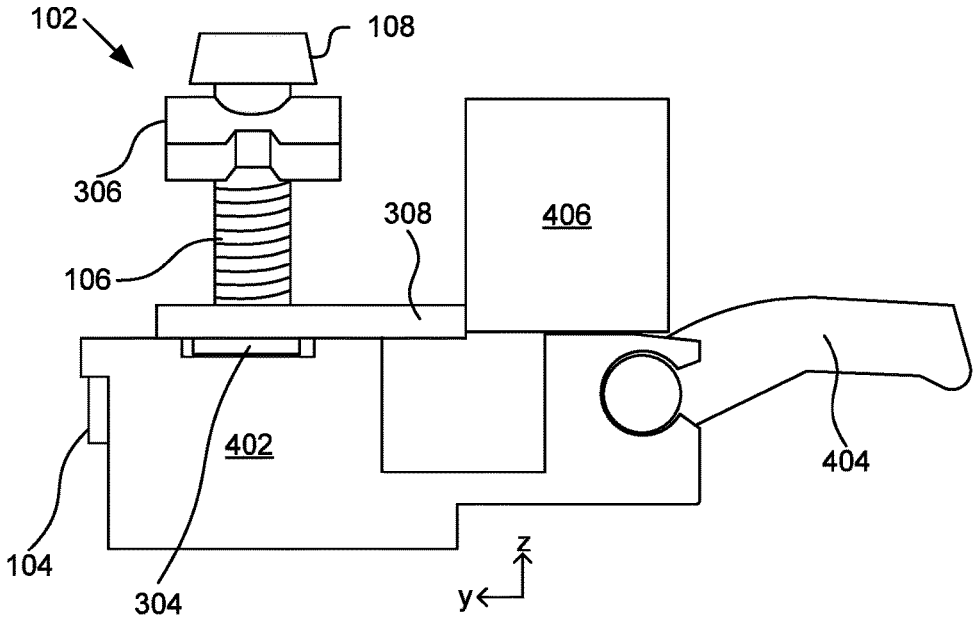
FIG. 4C is a side view further illustrating the embodiment of the trip unit of FIG. 4A.

FIG. 4A is a perspective view illustrating one embodiment of another trip unit 102 of a circuit breaker 100 with improved trip unit fixation. FIG. 4B is a front view further illustrating the embodiment of the trip unit 102 of FIG. 4A. FIG. 4C is a side view further illustrating the embodiment of the trip unit 102 of FIG. 4A. For example, the embodiment of FIGS. 4A-4C may depict a trip unit 102 with a body 402 of the trip unit 102, a short circuit trip lever 404 for mechanical linkage, and a short circuit element 406. The short circuit element 406 is not depicted in FIG. 4A for simplicity, but is included in some trip units 102. Note that the embodiment depicted in FIGS. 4A-4D is another particular design of a trip unit 102 and other designs of trip units 102 with a short circuit element and/or contact and with or without a bimetal strip that include a protrusion 104 and/or opening 206 are contemplated herein.

In some embodiments, the trip units 102 include a nut 304 or conductive element 308 with a threaded opening that matches threads on a threaded shaft of the bolt 106 so that turning the bolt 106 moves the head 108 of the bolt 106 and the angled clamp 306 toward the conductive element 308 of the trip unit 102. In other embodiments, the nut 304 is not included and the body 302/402 or conductive element 308 of the trip unit(s) 102 include an opening and threads for the bolt 106 to tighten into the body 302/402 or conductive element 308. When an end of a wire is placed under the angled clamp 306 and the bolt 106 is rotated to tighten the angled clamp 306 against the wire, uneven torque produced by the wire being on one side of the bolt 106 increases a tendency of the trip unit 102 to move. In addition, rotational forces of tightening the bolt 106 once the angled clamp 306 presses the wire against the conductive element 308 also increase a tendency of the trip unit 102 to move. The protrusion 104 secured in the opening 206 opposes the forces cause by tightening the bolt 106 and uneven forces of the wire being on one side of the bolt 106.

Figure 5A:
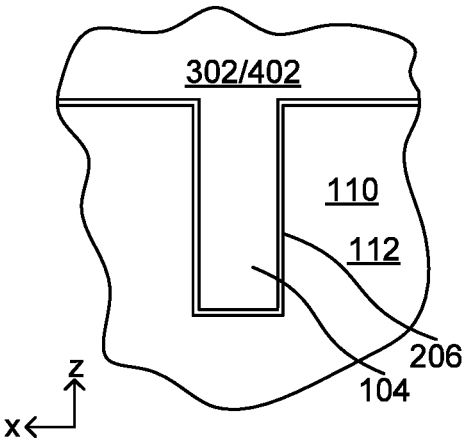
FIG. 5A is a partial front view illustrating one embodiment of a rectangular protrusion of a trip unit and a corresponding opening in a frame.
Figure 5B:
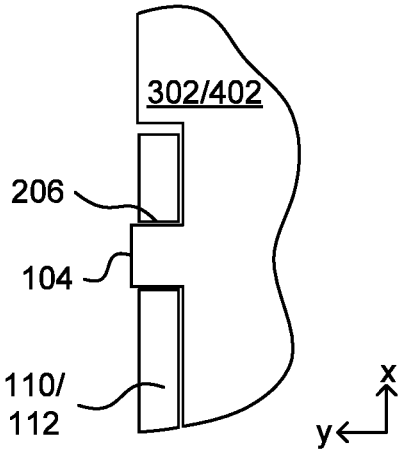
FIG. 5B is a partial top cross section view further illustrating the rectangular protrusion of FIG. 5A depicting an embodiment with perpendicular sides of the protrusion.
Figure 5C:
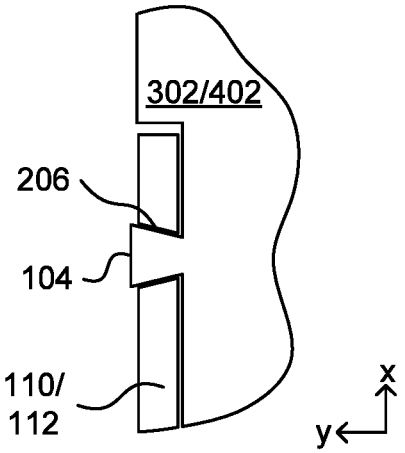
FIG. 5C is a partial top cross section view further illustrating the rectangular protrusion of FIG. 5A depicting an embodiment with angled sides of the protrusion.

In embodiments where the protrusion 104 is on the trip unit 102 and the opening 206 is in the frame 110, the protrusion 104 and opening 206 may be of various shapes that will resist movement of the trip unit 102 when wire is tightened into the terminal of the trip unit 102. FIG. 5A is a partial front view illustrating one embodiment of a rectangular protrusion 104 of a trip unit 102 and a corresponding opening 206 in a frame 110. FIG. 5B is a partial top cross section view further illustrating the rectangular protrusion 104 of FIG. 5A depicting an embodiment with perpendicular sides of the protrusion 104. FIG. 5C is a partial top cross section view further illustrating the rectangular protrusion 104 of FIG. 5A depicting an embodiment with angled sides of the protrusion 104. In the embodiment depicted in FIGS. 5A and 5B, the protrusion 104 has a width in the X-axis direction less than a length in the Z-axis direction. In some embodiments, the protrusion 104 extends through the opening 206. In other embodiments, the protrusion 104 extends into an opening 206 partially through the wall 112 of the frame 110.

In various embodiments, the protrusion 104 has various shapes in the Y-axis direction. In some embodiments, sides of the protrusion 104 in the Y-axis direction are perpendicular to a face of the wall 112 of the frame 110, as depicted in FIG. 5B. In other embodiments, the protrusion 104 is shaped differently, such as angling in a way to flair out so and end of the protrusion 104 distal to the trip unit 102 is wider than an end of the protrusion 104 adjacent to the trip unit 102, as depicted in FIG. 5C.

Figure 6:
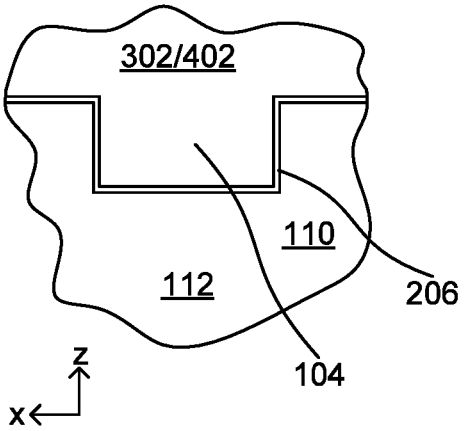
FIG. 6 is a partial front view illustrating another embodiment of a rectangular protrusion of a trip unit and a corresponding opening in a frame.
Figure 7:
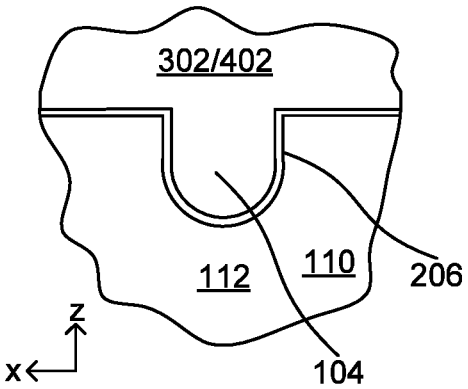
FIG. 7 is a partial front view illustrating another embodiment of a rounded rectangular protrusion of a trip unit and a corresponding opening in a frame.
Figure 8:
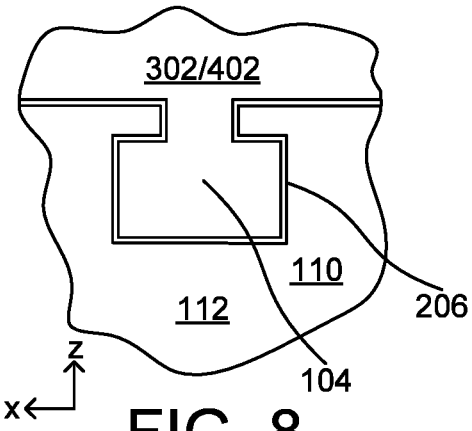
FIG. 8 is a partial front view illustrating another embodiment of a rectangular protrusion with a narrow section of a trip unit and a corresponding opening in a frame.

FIG. 6 is a partial front view illustrating another embodiment of a rectangular protrusion 104 of a trip unit 102 and a corresponding opening 206 in the frame 110. FIG. 7 is a partial front view illustrating another embodiment of a rounded rectangular protrusion 104 of a trip unit 102 and a corresponding opening 206 in the frame 110. FIG. 8 is a partial front view illustrating another embodiment of a rectangular protrusion 104 of a trip unit 102, where the protrusion 104 includes a narrow section and a wide section, and a corresponding opening 206 in the frame 110. In the embodiment, the protrusion 104 may be shaped like an extension from a puzzle piece any may serve to lock the trip unit 102 into the frame 110 to resist movement of the trip unit 102 in multiple directions.

Figure 9A:
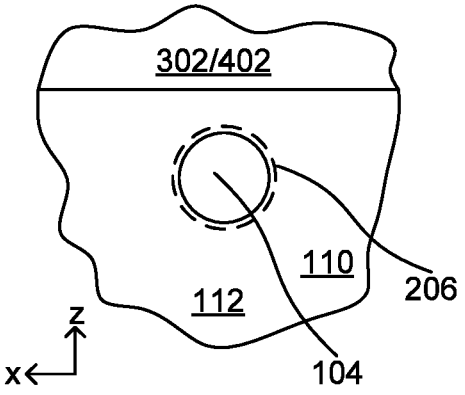
FIG. 9A is a partial front view illustrating another embodiment of a circular protrusion of a trip unit and a corresponding opening in a frame.
Figure 9B:
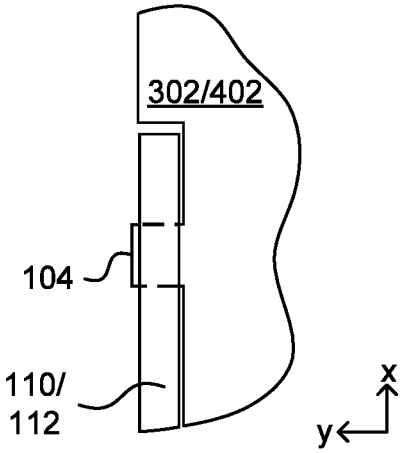
FIG. 9B is a partial side cross section view further illustrating the circular protrusion of FIG. 9A.

FIG. 9A is a partial front view illustrating another embodiment of a circular protrusion 104 of a trip unit 102 and a corresponding opening 206 in the frame 110 and FIG. 9B is a partial side cross section view further illustrating the circular protrusion 104 of FIG. 9A. The circular protrusion 104 has some advantages in that movement of the trip unit 102 is opposed in various directions in the X-Z plane by the circular protrusion 104.

Figure 10A:
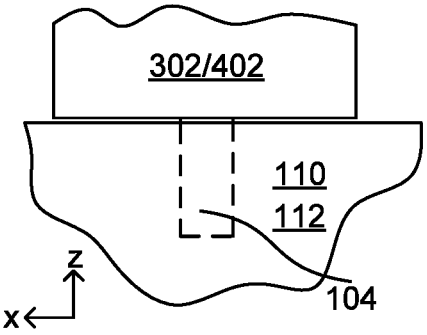
FIG. 10A is a partial front view illustrating another embodiment of a rectangular protrusion of a frame and a corresponding opening in a trip unit.
Figure 10B:
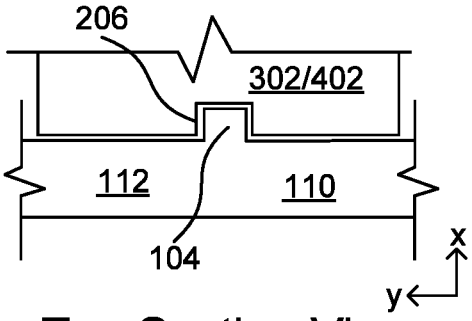
FIG. 10B is a partial top cross section view further illustrating the rectangular protrusion of FIG. 10A.

FIG. 10A is a partial front view illustrating another embodiment of a rectangular protrusion 104 of the frame 110 and a corresponding opening 206 in the trip unit 102. FIG. 10B is a partial side cross section view further illustrating the rectangular protrusion 104 of FIG. 10A. In the embodiment, the wall 112 of the frame 110 that is on the side of the trip unit 102 where wire is inserted includes a protrusion 104 that extends in the Y-axis direction toward the trip unit 102. The trip unit 102 includes a corresponding opening 206 that conforms to the protrusion 104 extending from the frame 110. Having a protrusion 104 extending from the frame 110 toward the trip unit 102 is advantageous to not have the protrusion 104 seen from or exposed to the exterior of the circuit breaker 100, which may provide some protection of the protrusion 104.

Figure 11A:
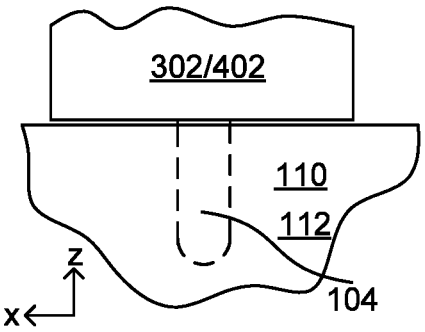
FIG. 11A is a partial front view illustrating another embodiment of a rounded rectangular protrusion of a frame and a corresponding opening in a trip unit.
Figure 11B:
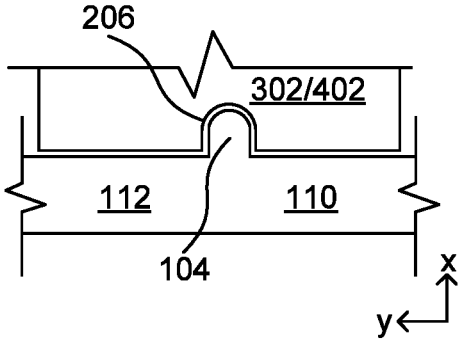
FIG. 11B is a partial top cross section view further illustrating the rounded rectangular protrusion of FIG. 11A.

FIG. 11A is a partial front view illustrating another embodiment of a rounded rectangular protrusion 104 of the frame 110 and a corresponding opening 206 in the trip unit 102. FIG. 11B is a partial side cross section view further illustrating the rounded rectangular protrusion 104 of FIG. 11A. Having a rectangular protrusion 104 with a rounded end may be advantageous to help guide the trip unit 102 during installation. While the rounded protrusion 104 is also rounded in the X-axis direction, other embodiments include a rectangular or square cross section in the X-Y plane above a rounded bottom section.

Figure 12A:
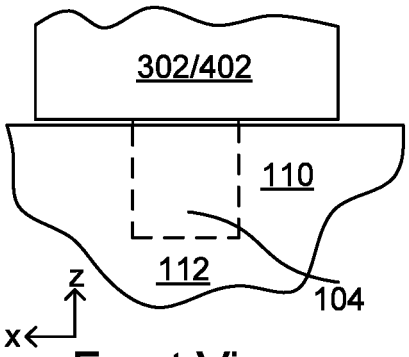
FIG. 12A is a partial front view illustrating another embodiment of a wide rectangular protrusion of a frame and a corresponding opening in a trip unit.
Figure 12B:
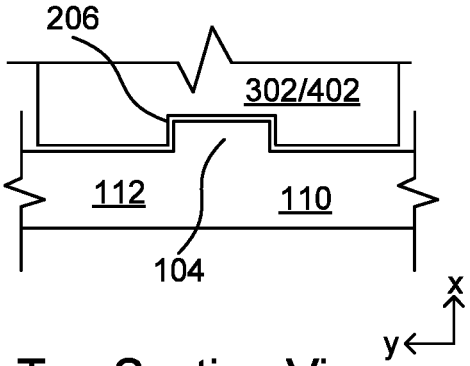
FIG. 12B is a partial top cross section view further illustrating the wide rectangular protrusion of FIG. 12A.

FIG. 12A is a partial front view illustrating another embodiment of a wide rectangular protrusion 104 of the frame 110 and a corresponding opening 206 in a trip unit 102. FIG. 12B is a partial side cross section view further illustrating the wide rectangular protrusion 104 of FIG. 12A. The wide rectangular protrusion 104 is similar to the embodiment of FIGS. 10A and 10B, but wider, which may be useful in strengthening the protrusion against lateral movement in the X-axis direction. While several embodiments of protrusions 104 and corresponding openings 206 are depicted, other embodiments are anticipated herein and one of skill in the art will recognize other designs for a protrusion 104 and corresponding opening 206 in frames 110 and trip units 102 that oppose forces caused by securing a wire into the terminal of the trip unit 102 of a circuit breaker 100.

This description uses examples to disclose the invention and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A circuit breaker comprising:

a frame comprising a trip unit slot; and a trip unit mounted in the trip unit slot of the frame, the trip unit comprising a terminal accessible from a top side of the trip unit above the trip unit slot, the top side facing away from the trip unit slot, the terminal configured to secure a wire to the trip unit, wherein one of a wall of the frame adjacent to the trip unit slot and a side of the trip unit facing the wall comprises a protrusion and the wall of the frame or the side of the trip unit without the protrusion comprises an opening, wherein the wall of the frame comprising the opening or the protrusion comprises an exterior wall of the frame, wherein the top side of the trip unit comprising access to the terminal is perpendicular to the side of the trip unit comprising the protrusion or opening, wherein the protrusion conforms to the opening and wherein the protrusion and opening are positioned to oppose movement of the trip unit in a direction of a force resulting from securing the wire in the terminal.

2. The circuit breaker of claim 1, wherein the protrusion and the opening are located on a side of the trip unit where the wire is inserted.

3. The circuit breaker of claim 1, wherein the terminal comprises a threaded shaft that is rotated to apply a force to the wire to secure the wire to the trip unit and wherein rotating the threaded shaft produces the force that secures the wire to the trip unit in a direction perpendicular to the threaded shaft.

4. The circuit breaker of claim 3, wherein the threaded shaft comprises a head accessible from the top side of the trip unit and the wire is secured to the trip unit on a side of the trip unit and the protrusion or opening is on a bottom portion of the side of the trip unit distal to the head of the threaded shaft.

5. The circuit breaker of claim 1, wherein the frame comprises a plurality of trip unit slots and the trip unit is one of a plurality of trip units, and wherein each trip unit slot comprises a trip unit of the plurality of trip units, wherein one of a wall of a trip unit slot of the plurality of trip unit slots and the trip unit in the trip unit slot comprises the protrusion and the wall of the trip unit slot or the trip unit in the trip unit slot without the protrusion comprises the opening.

6. The circuit breaker of claim 1, wherein opposing movement of the trip unit in the direction of the force resulting from securing the wire in the terminal further opposes movement of a first component of the trip unit shaped to contact a second component of the frame and/or another trip unit.

7. The circuit breaker of claim 1, wherein opposing movement of the trip unit in the direction of the force resulting from securing the wire in the terminal further opposes deformation of a wall of the trip unit slot that allows trip unit movement due to the force, wherein the wall of the trip unit slot affected by deformation is adjacent to the wall of the trip unit slot with the protrusion or opening.

8. The circuit breaker of claim 1, wherein the wall of the frame comprises the opening and the trip unit comprises the protrusion.

9. The circuit breaker of claim 8, wherein the protrusion extends through the wall of the frame.

10. The circuit breaker of claim 8, wherein the opening in the wall of the frame comprises a notch extending from a top edge of a trip unit slot where the trip unit is mounted in a direction away from the terminal of the trip unit and wherein the protrusion is shaped to fill the notch.

11. The circuit breaker of claim 8, wherein the opening in the wall of the frame comprises an opening below a top edge of a trip unit slot where the trip unit is mounted and wherein the protrusion of the trip unit is shaped to fill the opening.

12. The circuit breaker of claim 1, wherein the wall of the frame comprises the protrusion and the trip unit comprises the opening, wherein the protrusion extends toward the trip unit and the opening in the trip unit is shaped to conform to the protrusion extending from the wall of the frame.

13. A circuit breaker comprising:

a frame comprising a plurality of trip unit slots; and a trip unit mounted in each trip unit slot, each trip unit comprising a terminal accessible from a top side of the trip unit above the trip unit slot, the top side facing away from the trip unit slot, the terminal configured to secure a wire to the trip unit, wherein one of a wall of a trip unit slot of the plurality of trip unit slots adjacent to the trip unit slot and a side of the trip unit mounted in the trip unit slot facing the wall comprises a protrusion and the wall of the trip unit slot or the side of the trip unit mounted in the trip unit slot without the protrusion comprises an opening, wherein the wall of the frame comprising the opening or the protrusion comprises an exterior wall of the frame, wherein the top side of the trip unit mounted in the trip unit slot comprising access to the terminal is perpendicular to the side of the trip unit comprising the protrusion or opening, wherein the protrusion conforms to the opening and wherein the protrusion and opening are positioned to oppose movement of the trip unit mounted in the trip unit slot in a direction of a force resulting from securing the wire in the terminal.

14. The circuit breaker of claim 13, wherein the protrusion and the opening are located on a side of the trip unit where the wire is inserted.

15. The circuit breaker of claim 13, wherein the terminal comprises a threaded shaft that is rotated to apply a force to the wire to secure the wire to the trip unit and wherein rotating the threaded shaft produces the force that secures the wire to the trip unit.

16. The circuit breaker of claim 15, wherein the threaded shaft comprises a head accessible from the top side of the trip unit and the wire is secured to the trip unit on a side of the trip unit and the protrusion or opening is on a bottom portion of the side of the trip unit distal to the head of the threaded shaft.

17. The circuit breaker of claim 13, wherein opposing movement of the trip unit mounted in the trip unit slot in the direction of the force resulting from securing the wire in the terminal further opposes movement of a first component of the trip unit in the trip unit slot shaped to contact a second component of the trip unit slot.

18. The circuit breaker of claim 13, wherein opposing movement of the trip unit mounted in the slot in the direction of the force resulting from securing the wire in the terminal further opposes deformation of a wall of the trip unit slot that allows trip unit movement due to a rotational force, wherein the wall of the trip unit slot affected by deformation is adjacent to the wall of the trip unit slot with the protrusion or opening.

19. The circuit breaker of claim 13, wherein the wall of the trip unit slot comprises the opening and the trip unit mounted in the slot comprises the protrusion.

20. A system comprising:

an electrical device; and a circuit breaker coupled to the electrical device, wherein power transmitted through the circuit breaker feeds the electrical device, wherein the circuit breaker comprises:

a frame comprising a trip unit slot; and a trip unit mounted in the trip unit slot of the frame, the trip unit comprising a terminal accessible from a top side of the trip unit above the trip unit slot, the top side facing away from the trip unit slot, the terminal configured to secure a wire to the trip unit, wherein one of a wall of the frame adjacent to the trip unit slot and a side of the trip unit facing the wall comprises a protrusion and the wall of the frame or the side of the trip unit without the protrusion comprises an opening, wherein the wall of the frame comprising the opening or the protrusion comprises an exterior wall of the frame, wherein the top side of the trip unit comprising access to the terminal is perpendicular to the side of the trip unit comprising the protrusion or opening, wherein the protrusion conforms to the opening and wherein the protrusion and opening are positioned to oppose movement of the trip unit in a direction of a force resulting from securing the wire in the terminal.

* * * * *